United States Patent [19]

Embree et al.

[11] 4,323,797

[45] Apr. 6, 1982

[54] RECIPROCAL CURRENT CIRCUIT

[75] Inventors: Milton L. Embree, Reading, Pa.; William G. Garrett, Canton Township, Wayne County, Mich.

[73] Assignee: Bell Telephone Laboratories, Incorporated, Murray Hill, N.J.

[21] Appl. No.: 148,459

[22] Filed: May 9, 1980

[51] Int. Cl.[3] ..... G06G 7/12; G06G 7/24

[52] U.S. Cl. ..... 307/490; 307/503; 328/144

[58] Field of Search ..... 328/142, 145, 162, 144; 307/490, 492, 503; 324/132

[56] References Cited

U.S. PATENT DOCUMENTS

| | | | |
|---|---|---|---|
| 3,423,578 | 1/1969 | Platzer, Jr. et al. | 307/492 |
| 3,701,028 | 10/1972 | Markevich | 307/490 |
| 3,768,013 | 10/1973 | Kessler et al. | 328/142 |
| 3,986,048 | 10/1976 | Okada et al. | 307/490 |

*Primary Examiner*—Stanley D. Miller, Jr.
*Assistant Examiner*—B. P. Davis
*Attorney, Agent, or Firm*—H. W. Lockhart

[57] ABSTRACT

A circuit is provided in which the output current is the inverse, that is, the reciprocal, of the input current.

The circuit comprises an input current branch and an output current branch, each branch including the emitter-collector electrodes of one of matching transistors, and a reference current branch containing a pair of serially connected, like poled, diode-connected transistors. The base electrode of the input branch transistor is connected to a node in the reference branch on one side of both diode-connected transistors, and the emitter of the output branch transistor is connected to a node in the reference branch on the other side of both diode-connected transistors. The base of the output branch transistor is connected to a node in the input branch on the emitter side of the input branch transistor.

The circuit thus represents sums and differences of various voltages across the PN junctions in the several branches. Since these voltages are proportional to the logarithms of the corresponding currents, the circuit produces a resultant relationship in which the output branch current is directly proportional to the square of the reference current and inversely proportional to the input branch current.

2 Claims, 2 Drawing Figures

RECIPROCAL CURRENT CIRCUIT

This invention relates to electronic circuits and more particularly to a circuit for providing with a high degree of accuracy an output current which is the reciprocal of an input current.

There are occasions when it is desirable to provide in highly accurate fashion, and suitable for fabrication in semiconductor integrated circuit form, a circuit in which the output current is the reciprocal of the input current.

Although a wide variety of functions are performed by known electronic circuits, a circuit producing a current which is the reciprocal of another current, in accurate and compact form, does not appear to be readily available.

SUMMARY OF THE INVENTION

The invention in one specific embodiment is a circuit comprising an input current branch and an output current branch, each branch including the emitter-collector electrodes of one of matching transistors, and a reference current branch containing a pair of serially connected, like poled, assymmetrically conducting semiconductor devices. Typically, these are diode-connected transistors. The base electrode of the input branch transistor is connected to a node in the reference branch on one side of both diode-connected transistors, and the emitter of the output branch transistor is connected to a node in the reference branch on the other side of both diode-connected transistors. The base of the output branch transistor is connected to a node in the input branch on the emitter side of the input branch transistor.

The circuit thus represents sums and differences of various voltages across the PN junctions in the several branches. Since these voltages are proportional to the logarithms of the corresponding currents, the circuit produces a resultant relationship in which the output branch current is directly proportional to the square of the reference current and inversely proportional to the input branch current.

In a further embodiment, additional circuit means are provided, including current mirrors and a doubling transistor for producing and feeding back a current component which corrects for the base current of the output branch transistor, which is not negligible as assumed in the basic circuit configuration.

BRIEF DESCRIPTION OF THE DRAWING

The invention and its objects and features will be better understood from the following description taken in conjunction with the drawing in which.

DETAILED DESCRIPTION

Figure 1:
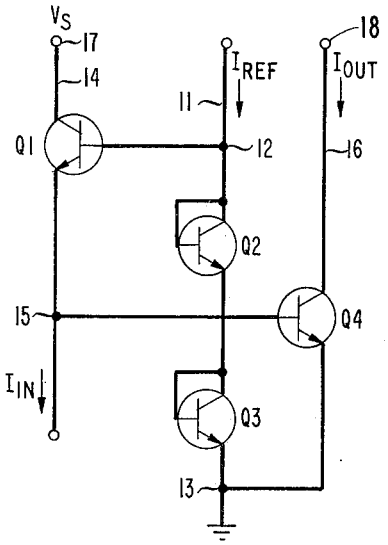
FIG. 1 is a circuit schematic of one specific embodiment in accordance with the invention.

In the circuit of FIG. 1 input current branch 14 includes the emitter-collector circuit of transistor $Q_1$. Reference current branch 11 includes diode-connected transistors $Q_2$ and $Q_3$, serially connected between a first node 12 and a first terminal 13 which is connected to ground in this embodiment. It will be understood that the magnitude of the voltage at terminal 13 is related to the voltage at node 17 and is such as to provide for suitable biasing of transistor $Q_1$.

An output current branch 16 includes the emitter-collector circuit of transistor $Q_4$ with its emitter connected to first terminal 13, and its collector connected to second terminal 18.

The base of transistor $Q_4$ is connected directly to a second node 15 located on the emitter side of transistor $Q_1$ in the input current branch 14. The base of transistor $Q_1$ is connected to first node 12 in the reference current branch 11.

In the specific embodiment of FIG. 1, all transistors are of the NPN type and the current directions, assuming a voltage $V_s$ applied at node 17 of the input current branch 14, are as shown. The magnitude of voltage $V_s$ is that sufficient to drive transistor $Q_1$.

In the operation of this circuit, current $I_{IN}$ flows through transistor $Q_1$ from collector to emitter resulting in a base-emitter voltage $V_{BEQ\,①}$, proportional to the logarithm of this current. Similarly, current $I_{REF}$ in the reference current branch 11 flows through diode-connected transistors $Q_2$ and $Q_3$ setting up base-emitter voltages proportional to the logarithm of current $I_{REF}$.

From the circuit configuration, the base-emitter voltage of transistor $Q_4$ is the difference between the sum of the base-emitter voltages of $Q_2$ and $Q_3$ and the base-emitter voltage of $Q_1$. Thus, the base-emitter voltage of transistor $Q_4$ represents the difference between twice the logarithm of current $I_{REF}$ and the logarithm of current $I_{IN}$. The sum of logarithms represents products and the difference, quotients. Therefore, the base-emitter voltage of $Q_4$ represents the logarithm of the quotient of the current $I_{REF}$ squared divided by current $I_{IN}$.

If, as previously assumed, the base current $I_b$ of transistor $Q_4$ is negligible, then the collector current $I_{OUT}$ of $Q_4$ is proportional to the antilogarithm of its base-emitter voltage and thus current $I_{OUT}$ is equal to the current $I_{REF}$ squared, divided by current $I_{IN}$.

The foregoing can be expressed mathematically for the embodiment of FIG. 1 assuming, as stated before, that the base current ($I_B$) of transistors $Q_1$ and $Q_4$ is negligible. All transistors are assumed to be identical and to have identical values of saturation current $I_S$. For the following expressions, the usual designations E, B, and C are used to denote parameters relating to emitter, base, and collector of the respective transistor. Then:

$$I_{EQ\,①} = I_{IN} \tag{1}$$

and $$V_{BEQ_1} = V_T \ln \frac{I_{EQ_1}}{I_S} \tag{2}$$

$$V_{BEQ_1} = V_T \ln \frac{I_{IN}}{I_S} \tag{3}$$

where $V_T = KT/q$. ($V_T$ is approximately 26 millivolts at 25 degrees C.), and $I_S$ is the transistor saturation current. Also, $$I_{EQ\,②} = I_{EQ\,③} = I_{REF} \tag{4}$$

and $$V_{BEQ_{(2)}} = V_{BEQ_{(3)}} = V_T \ln \frac{I_{REF}}{I_S} \quad (5)$$

Also, $$I_{EQ_{(4)}} = I_{CQ_{(4)}} = I_{OUT} \quad (6)$$

and $$V_{BEQ4} = V_T \ln \frac{I_{EQ4}}{I_S} \quad (7)$$

$$V_{BEQ4} = V_T \ln \frac{I_{OUT}}{I_S} \quad (8)$$

From Kirchoff's Law (around closed circuit from node 13, to node 15, to node 12 and back to node 13).

$$V_{BEQ_{(4)}} + V_{BEQ_{(1)}} - V_{BEQ_{(2)}} - V_{BEQ_{(3)}} = 0 \quad (9)$$

Substituting, $$V_T \ln \frac{I_{OUT}}{I_S} + V_T \ln \frac{I_{IN}}{I_S} - V_T \ln \frac{I_{REF}}{I_S} - V_T \ln \frac{I_{REF}}{I_S} = 0 \quad (10)$$

$$\ln \frac{I_{OUT}}{I_S} = 2 \ln \frac{I_{REF}}{I_S} - \ln \frac{I_{IN}}{I_S} \quad (11)$$

$$\frac{I_{OUT}}{I_S} = \frac{\frac{I_{REF}^2}{I_S^2}}{\frac{I_{IN}}{I_S}} \quad (12)$$

$$\frac{I_{OUT}}{I_S} = \frac{I_{REF}^2}{I_S I_{IN}} \quad (13)$$

$$I_{OUT} = \frac{I_{REF}^2}{I_{IN}} \quad (14)$$

Figure 2:
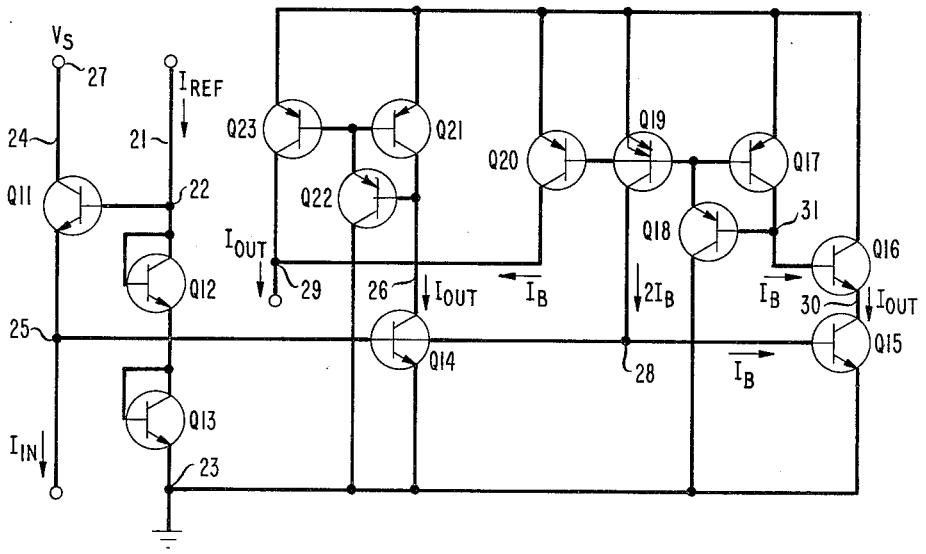
FIG. 2 is a circuit schematic showing, in addition to the basic circuit, circuit means for feeding back corrective current components.

The embodiment depicted in FIG. 2 provides a convenient circuit means for correcting the small error arising from the assumption that the base current $I_B$ of transistor $Q_4$ of FIG. 1 is negligible. This assumption affects both of the currents $I_{IN}$ and $I_{OUT}$. If $I_B$ of transistor $Q_4$ is not negligible, then $I_{IN}$ at node 15 will divide, and the emitter current $I_{EQ\ 1}$ of $Q_1$ will not exactly equal $I_{IN}$. Also the collector current $I_C$ of transistor $Q_4$ is taken as equal to the emitter current $I_E$, a reasonable assumption only if the base current $I_B$ is zero. The current $I_{OUT}$ is the same as collector current $I_C$ and therefore also contains a small error dependent upon the existence and magnitude of a base current $I_B$. The circuit shown in FIG. 1 will provide the results described above with an accuracy of within about two or three percent over a limited range of the ratio of the output to input current. The circuit arrangement provided in FIG. 2 reduces the error to within a few tenths of one percent.

In FIG. 2 current branches 21, 24, and 26 are, respectively, the reference current branch, the input current branch, and the output current branch. The circuit and elements encompassed by these branches are a duplicate of the circuit of FIG. 1.

Turning to the added compensating circuitry of FIG. 2, transistor $Q_{15}$ is a counterpart of output branch transistor $Q_{14}$ and produces an equivalent current $I_{OUT}$ in its collector circuit 30 which is a branch in parallel with output current branch 26, and, as shown, has a base current $I_B$ equal to the base current of transistor $Q_{14}$. Transistor $Q_{16}$ in the collector circuit of transistor $Q_{15}$ provides a replica of current $I_B$ to the double-output current mirror configuration consisting of transistors $Q_{17}$, $Q_{18}$, $Q_{19}$, and $Q_{20}$. Thus, transistors $Q_{15}$ and $Q_{16}$ constitute current-replicating means for providing current $I_B$ at node 31. Transistor $Q_{19}$, which is shown as having two emitters, is a current-doubling transistor. Consequently, the current at node 31 which is essentially $I_B$, is "mirrored" at the collector of transistor $Q_{19}$ at twice that value or $2I_B$, which then is fed back at node 28. The current $2I_B$ feedback at node 28 provides compensation with respect to the base current $I_B$ of transistor $Q_{14}$ and base current $I_B$ of transistor $Q_{15}$, both of which have been assumed to be zero in the foregoing analysis, but may not be so.

Transistor $Q_{20}$ mirrors current $I_B$ at its collector which then is fed to node 29. Transistors $Q_{21}$, $Q_{22}$, and $Q_{23}$ constitute a single-output current mirror which provides a replica of current $I_{OUT}$ as the collector current of transistor $Q_{23}$ to combine at node 29 with current $I_B$. This correction is occasioned by the error described above introduced by assuming that the collector current $I_C$ of transistor $Q_{14}$ is equal to its emitter current $I_E$, which is the current used in the foregoing analysis deriving the relationship between $I_{IN}$ and $I_{OUT}$. Thus, since $I_{OUT}$ is $I_C$ in branch 26 and differs from $I_E$ by the value of current $I_B$, adding $I_B$ to $I_{OUT}$ at node 29 produces a more accurate current at node 29 denoted the corrected output current $I_{OUT}'$.

Alternatively to the current-replicating means constituted by transistors $Q_{15}$ and $Q_{16}$, other means may be used for providing current $I_B$ to the compensating feedback circuit. For example, an operational amplifier having unity gain could be placed in the branch between node 28 and transistor $Q_{15}$ in FIG. 2. Such a configuration would provide current $I_B$ to node 31 without drawing any current from node 28. Therefore, the compensating current fed back to node 28 from the first current mirror would be one $I_B$, and the current-doubling transistor $Q_{19}$ would be a single emitter device.

It will be understood that other circuit configurations can be devised which are the full equivalent of the embodiments disclosed above. In particular, in certain parts of the circuit, transistor pairs in Darlington configurations may be used.

We claim:

1. An electronic circuit having an output current which is the reciprocal of an input current comprising, (a) a first terminal 13, (b) a reference current branch 11 connected to the first terminal 13 and containing a first node 12, (c) a pair of asymmetrically conducting semiconductor devices $Q_2$, $Q_3$ serially connected in the reference current branch 11 both poled for easy conduction in the same direction, (d) an input current branch 14 including a first transistor $Q_1$ having its emitter and collector in said branch and including a second node 15 in the portion connected to the emitter, (e) first interconnecting means coupling the base of the first transistor $Q_1$ to the first node 12 in the reference branch, (f) an output current branch 16 including a second transistor $Q_4$ having its emitter and collector in said branch and having the portion connected to the emitter terminating at the first terminal 13, and having the portion connected to the collector terminating at a second terminal 18, (g) second interconnecting means coupling the base of the second transistor to the second node 15 in the input branch 14, (h) circuit compensating means comprising (1) a counterpart output branch 30 connected in parallel with said output current branch and including current replicating means having an input connection from the base of the second transistor; (2) first current mirror means connected to the counterpart output branch and having a feedback connection to said input connection to the replicating means; (3) a corrected output terminal 29; (4) second current mirror means connected between said output current branch and the corrected output terminal; (5) a connection from the first current mirror to the corrected output terminal.

2. The circuit in accordance with claim 1 in which said first current mirror means includes a current doubling transistor in the feedback path to the input connection to the replicating means.

* * * * *